US005095834A

United States Patent [19]

Braun

[11] Patent Number: 5,095,834

[45] Date of Patent: Mar. 17, 1992

[54] SEWING MACHINE WITH SWINGABLE STITCH FORMING UNIT

[75] Inventor: Oskar Braun, Hochspeyer, Fed. Rep. of Germany

[73] Assignee: Pfaff Industriemaschinen GmbH, Kaiserslautern, Fed. Rep. of Germany

[21] Appl. No.: 585,147

[22] PCT Filed: Mar. 18, 1989

[86] PCT No.: PCT/EP89/00293

§ 371 Date: Nov. 19, 1990

§ 102(e) Date: Nov. 19, 1990

[87] PCT Pub. No.: WO89/09851

PCT Pub. Date: Oct. 19, 1989

[30] Foreign Application Priority Data

Apr. 9, 1988 [DE] Fed. Rep. of Germany ..... 3811897

[51] Int. Cl.[5] ..... D05B 21/00; D05B 3/02

[52] U.S. Cl. ..... 112/121.12; 112/121.14; 112/221; 112/443

[58] Field of Search ..... 112/121.12, 121.14, 112/221, 443, 220, 221

[56] References Cited

U.S. PATENT DOCUMENTS

| | | | |
|---|---|---|---|
| 3,450,076 | 6/1969 | Bender | 112/121.12 X |
| 4,674,421 | 6/1987 | Iwase | 112/121.12 |
| 4,787,324 | 11/1988 | Fischer et al. | 112/121.12 |
| 4,867,084 | 9/1989 | Braun | 112/443 X |

FOREIGN PATENT DOCUMENTS

| | | | |
|---|---|---|---|
| 3000831 | 7/1981 | Fed. Rep. of Germany | 112/121.12 |

*Primary Examiner*—Peter Nerbun
*Attorney, Agent, or Firm*—McGlew & Tuttle

[57] ABSTRACT

A sewing machine with a pivotable stitch formation unit is provided such that it is possible to form a straight stitch or a zigzag stitch seam without loop stitches occurring on the fabric. The fabric is displaceable under the needle without rotation because of a pivoting arrangement of the head and the shuttle holder. The arrangement allows the sewing machine to be switched over from a straight stitch to a zigzag stitch operation due to the adjustment of the oscillation frequency of the needle bar holder relative to the oscillation frequency of the needle bar by means of a multistep shifting gear.

5 Claims, 2 Drawing Sheets

SEWING MACHINE WITH SWINGABLE STITCH FORMING UNIT

FIELD OF THE INVENTION

The present invention pertains to a sewing machine with a stitch formation unit including a head and shuttle holder which may be guided along a predeterminable seam line. The head is provided with a needle bar holder mounted transversely movably for receiving the needle bar driven to perform oscillating movement in the direction of its longitudinal axis. The needle bar holder may be driven via a gear drive with an oscillation frequency corresponding to the oscillating frequency of the needle bar.

BACKGROUND OF THE INVENTION

Such a sewing machine has been known from West German Patent Specification No. DE-PS 3,336,683. A fabric clamped in a fabric holder is moved by a feed mechanism relative to the needle under the head of the sewing machine.

The needle bar is received by a needle bar rocker mounted in the head, which is driven for needle transport. The pivotable mounting of the head makes it possible to perform the needle transport movement for any stitch formation in the direction of the feed motion of the fabric in any direction of feed of the fabric relative to the stitch formation site. The pivotable design of the shuttle holder guarantees that the shuttle is always in the correct position relative to the needle. Even though the pivotable arrangement of the head and shuttle holder permits stitch formation without pivoting the fabric, the function of the sewing machine is limited to straight stitch seams prepared with needle feed. These seams can be prepared with tacking or locking stitches.

SUMMARY AND OBJECTS OF THE INVENTION

It is an object of the present invention to design a sewing machine with a fabric holder for moving the fabric without pivoting such that different types of seams can be prepared while maintaining stitches formed at the stitch formation site at a predeterminable angle to the direction of feed of the fabric.

According to the invention, a sewing machine is provided with a stitch formation unit. The stitch formation unit includes a head and a shuttle holder which may be guided along a predeterminable seam line. The head is provided with a needle bar holder, mounted transversely movably for receiving the needle bar driven to perform oscillating movement in the direction of its longitudinal axis. The needle bar holder may be driven via a gear drive with an oscillation frequency corresponding to the oscillating frequency of the needle bar, the gear drive is designed to change this frequency ratio in a plurality of steps and has a shifting device for shifting from one gear ratio to another.

As a consequence of the use of the multistep gear drive in a sewing machine with pivotable head and pivotable shuttle holder, it is additionally possible, while maintaining all the usual advantages of this class of machine, to form seams with different stitch types, such as straight stitch or zigzag stitch. This may be done by changing the oscillation frequency of the needle bar holder relative to the oscillation frequency of the needle bar, so that it is not necessary to transfer the fabric to another sewing machine in order to prepare another seam.

Due to the pivotable arrangement of the head and shuttle holder, the needle and the shuttle can always be moved into the position that is optimal for stitch formation, so that no loop stitches are formed, regardless of the type of stitch to be prepared.

Even though sewing machines designed for performing different types of stitching have been known from the state of the art, these are sewing machines which belong to a different class compared with the sewing machine according to the invention and therefore fail to offer its special advantages.

For example, a sewing machine with stationary head and shuttle holder, whose needle bar is mounted in a needle bar rocker, has been known from West German Patent Specification No. DE-PS 3,000,831. To deflect the needle bar rocker, a crank mechanism connected to a two-step gear drive acts on it.

The gear drive is provided to transform the movement received from the arm shaft and to transmit it, depending on its shifting position, to the needle bar rocker in a ratio of 1:1 or 1:2 relative to the oscillation frequency of the needle bar, so that straight stitch or zigzag seams can be prepared with either tacking stitches or locking stitches.

Because of the immovable arrangement of the head and shuttle holder, a fabric holder is provided, which is displaceable in two directions and can also be pivoted around an axis that is eccentric relative to the needle axis.

When the fabric is fed at a defined angle relative to the stitch formation site in this class of sewing machines, there is a risk of loop stitch formation, because no measures to avoid loop stitches are provided in the sewing machine.

The pivotable design of the fabric holder increases the technical expense of the feed mechanism. In addition, a pivotable fabric holder is disadvantageous, especially in the case of large pieces of fabric, because these are subject to additional displacing forces during pivoting movements and require a larger support surface.

Designing the gear drive as a toothed gear drive provides an advantageous embodiment of the gear drive, providing the shifting device designed as a cylinder for a pressurized medium acting on a gear shifting gate of the gear drive provides a shifting device of particularly simple design, and designing the gear shifting gate as a bushing made in one piece with a double gear, which bushing is displaceable on a shaft of the gear drive, along with a disk that is in driving connection with the shifting device provides an advantageous embodiment of a shifting gate for shifting the individual transmission steps.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE EMBODIMENT

Figure 1:
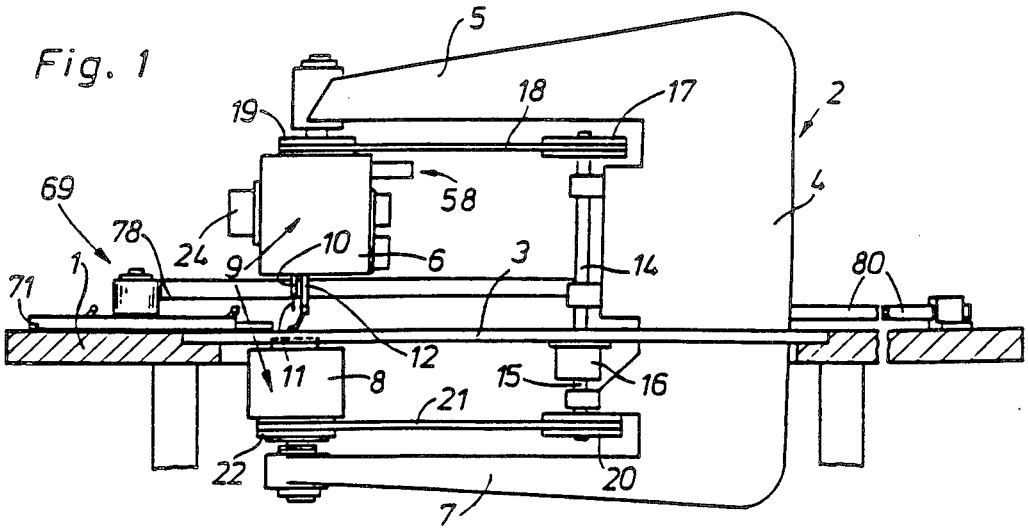
FIG. 1 is a side view of a sewing machine according to the invention.

FIG. 1 shows a frame whose table plate 1 serves to receive a sewing machine 2. The housing of the sewing machine 2 consists of a base plate 3, a stand 4, a top arm 5 with pivotably held head 6, and a lower arm 7 with a pivotably arranged shuttle holder 8. A pivotable stitch formation unit 9 is formed by the head 6 and the shuttle holder 8. The head 6 carries a needle bar 10 with a needle 11 and a presser foot 12. A needle plate 13 (FIG. 1) is accommodated in the base plate 3.

A shaft 14 is mounted on the upper part of the stand 4 and a shaft 15 is mounted on the lower part. Both shafts 14 and 15 are driven by a stepping motor 16, which is energized by a control device of the sewing machine 2 (not shown). A belt pulley 17, which is connected via a belt 18 to a belt pulley 19 arranged nonrotatably on the head 6, is arranged on the upper end of the shaft 14. A belt pulley 20, at the lower end of the shaft 15, is connected via a belt 21 to a belt pulley 22, fastened on the shuttle holder 8.

Figures 2, 3:
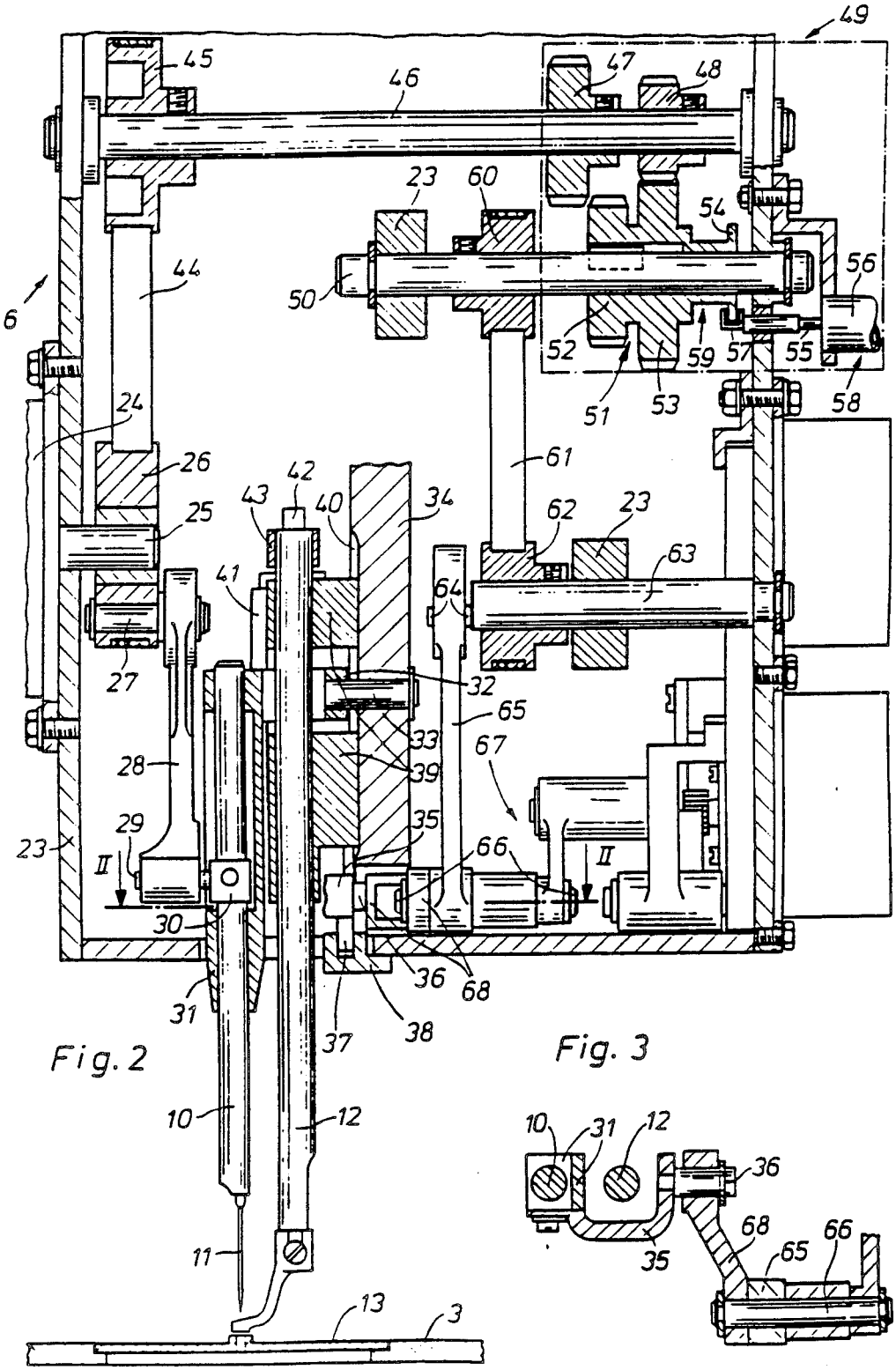
FIG. 2 is a cross sectional view taken through the head of the sewing machine according to the invention.
FIG. 3 is a cross sectional view taken through the needle bar holder along line II—II in FIG. 2; and, FIG. 4 shows a top view of the sewing machine according to the invention.

FIG. 2 shows the head 6 on a larger scale. A motor 24, which has a motor shaft 25 guided in the housing 23, is flanged onto the housing 23 of the head 6. A toothed belt pulley 26, which carries an eccentrically arranged pin 27 and serves as a crank, is fastened on the motor shaft 25. The free end of the pin 27 is surrounded by one end of an eccentric rod 28, whose other end surrounds a pin 29. The pin 29 is made in one piece with a clamp 30, which is fastened on the needle bar 10.

The needle bar 10 is movable in the direction of its longitudinal axis in a needle bar holder 31 mounted pivotably in the housing 23. For pivotable mounting, the needle bar holder 31 has a shackle 32, on which a pin 33 is fastened. The pin 33 is pivotably received in a mounting rib 34 of the housing 23.

Another shackle 35 (FIG. 3), which has a pin 36, is provided at the lower end of the needle bar holder 31, made in one piece with the latter. The shackle 35 is connected to a guide rocker 37, which is guided in a groove of a plate 38 arranged on the housing 23.

The mounting rib 34 is provided for receiving a holder 39 of the presser foot 12. The holder 39 is movable in the vertical direction. For guiding, the holder 39 extends into a groove 40 of the mounting rib 34. A cylinder 41, operated by a pressurized medium, whose piston rod 42 is connected via a clamp 43 to the presser foot 12 for driving same, is fastened on the housing 23 adjacent to the mounting rib 34.

The movement received by the toothed belt pulley 26 is transmitted by a toothed belt 44 onto a toothed belt pulley 45, which is clamped on a shaft 46. The movement of the shaft 46 is also shared by gears 47 and 48 of a shiftable gear drive 49 outlined by broken lines in FIG. 2, which gears are connected nonrotatably to the shaft.

A shaft 50, on which a double gear 51 is mounted nonrotatably, also belongs to the gear drive 49. The double gear 51 has gear parts 52 and 53 with different diameters and a bushing, made in one piece with a disk 54. The piston rod 55 of a cylinder 56, operated by a pressurized medium, has at its free end a claw 57, which acts on the disk 54. The double gear 51 is axially displaceable on the shaft 50 by the shifting device 58 designed as a cylinder 56. The bushing with the disk 54 acts as a shifting gate 59.

Depending on the setting of the shifting device 58, either the gear 47 engages with the gear part 52, or the gear 48 engages with the gear part 53, wherein the gear 47 and the gear part 52 have the same diameter, whereas the diameter of the gear 48 is half that of the gear part 53.

A toothed belt pulley 60, whose rotary movement is transmitted via a toothed belt 61 to a toothed belt pulley 62, which is fastened on a power take-off shaft 63 mounted rotatably in the housing 23, is clamped on the shaft 50.

One end of the power take-off shaft 63 has a pin 64 made in one piece with it and mounted eccentrically to the shaft axis. The pin 64 is surrounded by one end of an eccentric rod 65, whose other end is connected via a pin 66 to a connecting rod type stitch-regulating mechanism 67 of ordinary design. A rocker 68, whose other end is hinged to the pin 36 of the needle bar holder 31, additionally acts on the pin 66.

Figure 4:
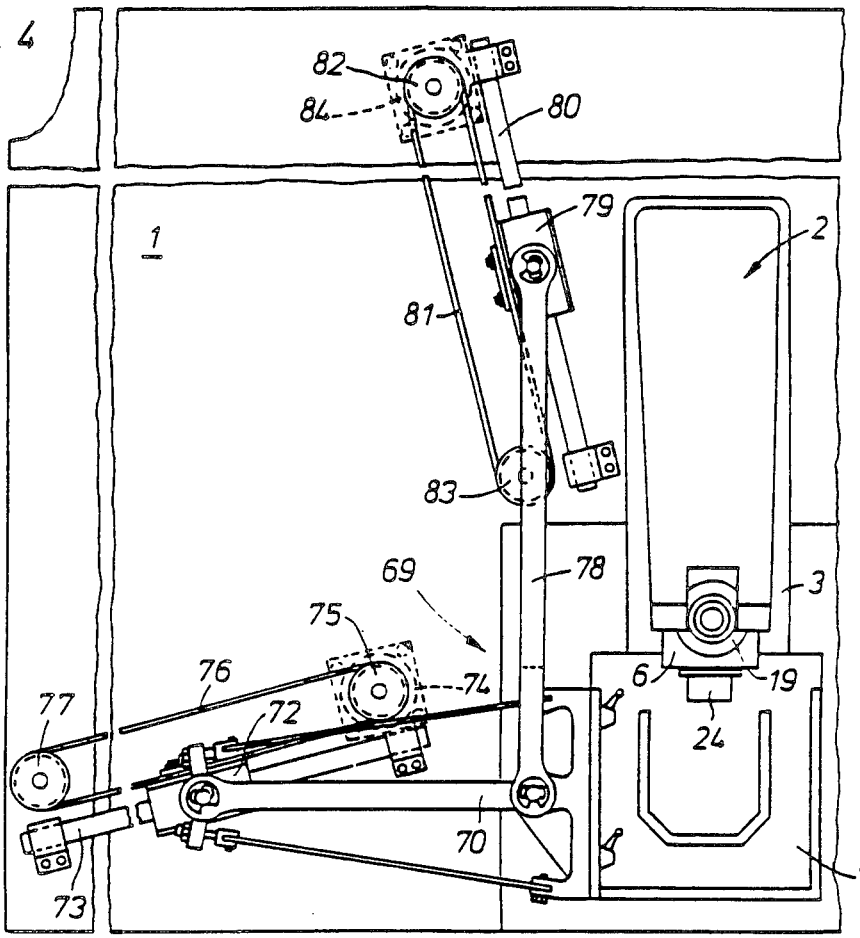

A feed mechanism 69 shown in FIG. 4 is arranged on the table plate 1. The feed mechanism 69 has a pivot arm 70, one end of which detachably holds a fabric holder 71. The other end of the pivot arm 70 is connected to a slide 72, which is mounted displaceably on a sliding rail 73 fastened on the table plate 1. A stepping motor 74, which drives a toothed belt 76 via a belt pulley 75, is provided for driving the slide 72. This belt pulley 75 is rigidly connected to the slide 72 and is deflected by a belt pulley 77.

One end of a second pivot arm 78, whose opposite end is connected to a slide 79, acts in a hinged manner at a closely spaced location from the end of the pivot arm 70 receiving the fabric holder 71. This slide 79 is also displaceably mounted on a sliding rail 80 and is fastened to a toothed belt 81 which is guided over belt pulleys 82 and 83. To drive the slide 79, the belt pulley 82 is connected to a stepping motor 84.

The device operates as follows:

The toothed belt pulley 26, whose rotary movement is used to drive the needle bar 10 via the eccentric rod 28, is driven by the rotary movement of the motor shaft 25. At the same time, the rotary movement of the toothed belt pulley 26 is used to drive the toothed belt pulley 45 and consequently the shaft 46 via the toothed belt 44.

The movement of the shaft 46 is transmitted via the gear drive 49 to shaft 50 and, from this shaft—via the belt pulley 60, the toothed belt 61 and the belt pulley 62—to the power take-off shaft 63.

The rotation speed of the power take-off shaft 63 depends on the setting of the gear drive 49. When the piston rod 55 of the cylinder 56 is extended, the double gear 51 is axially displaced via the disk 54/claw 57 connection, so that the gear 47 will engage with the gear part 52. The rotation of the motor shaft 25 is then transmitted to the shaft 50 and consequently to the power take-off shaft 63 in a ratio of 1:1.

In the second shifting position, the piston rod 55 is withdrawn into the cylinder 56. The double gear 51 assumes the position shown in FIG. 2. In this position, the gear 48 engages with the gear part 53, and the power take-off shaft 63 is driven at half the speed of the motor shaft 25.

Movement, whose oscillation frequency is determined by the setting of the gear drive 49, is transmitted by the eccentrically arranged pin 64 to the eccentric rod 65 and from this, it is transmitted—via the pin 66, the rocker 68, and the pin 36—to the shackle 35 of the needle bar holder 31. As a result, the needle bar holder 31 performs oscillating movements around the pin 33. The amplitude of these movements, usually called overstitch width, depends on the setting of the stitch-regulating mechanism 67.

At a speed ratio of 1:1 between the motor shaft 25 and the power take-off shaft 63, the needle bar holder 31 passes over the preselected overstitch width in a to and fro movement, while the needle bar 10 is moved up and down once for one stitch, and the needle 11 plunges into the fabric at the first reversal point of the needle bar holder 31 and leaves same at the second reversal point. The sewing machine 2 will now operate with needle feed for straight stitch seams.

When a 2:1 ratio has been set between the motor shaft 25 and the power take-off shaft 63, the needle bar holder 31 passes over only half the overstitch width during one stroke of the needle bar. In this setting, the needle 11 plunges into the fabric and leaves same at both reversal points of the needle bar holder 31. The sewing machine 2 will now operate in zigzag fashion for zigzag sewing.

When, for example, a pocket is to be sewn onto a fabric cut, it is placed together with this cut into the fabric holder 71. The fabric holder 71 is moved by the feed mechanism 69, based on appropriate energization of the stepping motors 74 and 84, from its resting position shown in FIG. 4 into the sewing position, in which the point at which sewing is to begin is located under the needle 11. In this position, the head 6 and the shuttle holder 8 of the sewing machine 2 are in a neutral starting position corresponding to the representation in FIG. 1, in which the transverse movement of the needle bar holder 31 takes place in a plane perpendicular to the plane of the drawing. The sewing machine 2 is then turned on and the gear drive 49 is set according to the stitch to be formed.

While the feed mechanism 69 drives the part holder 71 as a function of the pattern of the seam, the head 6 is pivoted via the belt 18, by correspondingly energizing the stepping motor 16, to the extent that the transverse movements of the needle bar holder 31 and consequently also the needle 11 are performed in the respective correct direction at the stitch formation site. The movement of the feed mechanism 69 must be synchronous to the transverse movement of the needle 11, because, for example, the fabric is being fed with the needle 11 plunged in during needle feed. The direction of motion of the feed mechanism 69 now corresponds to the transverse movement of the needle 11, while it is directly at right angles thereto in the case of zigzag operation.

The shuttle holder 8 is pivoted synchronously by the stepping motor 16 during the pivoting of the head 6. As a result, the shuttle is always in the correct position relative to the needle 11, so that straight stitch or zigzag stitch seams can be prepared with both tacking stitches and locking stitches without loop stitches.

While a specific embodiment of the invention has been shown and described in detail to illustrate the application of the principles of the invention, it will be understood that the invention may be embodied otherwise without departing from such principles.

I claim:

1. A sewing machine, comprising:

a stitch formation unit including a stitch formation unit head and a shuttle holder, said stitch formation unit being guidable along a predetermination seam line, said stitch formation head including a needle bar holder mounted transversely movable for receiving the needle bar driven to perform oscillating movement in the direction of its longitudinal axis;

a gear drive connected to said needle bar holder for driving said needle bar holder with an oscillation frequency corresponding to the oscillating frequency of the needle bar, said gear drive including step frequency ratio means for changing a ratio of the gear drive oscillation frequency to the oscillating frequency of the needle bar, said step frequency ratio means including a shifting device for shifting from one gear ratio to another.

2. A sewing machine according to claim 1, wherein said gear drive is formed as a tooth gear drive.

3. A sewing machine according to claim 1, wherein said shifting device includes a pressurized medium actuated cylinder acting on a gear shifting gate of the gear drive.

4. A sewing machine according to claim 3, wherein said gear shifting gate is designed as a bushing made in one piece with a double gear, said bushing being displaceable on a shaft of the gear drive, along with a disk that is in driving connection with the shifting device.

5. A sewing machine according to claim 3, wherein the gear shifting gate is designed as a bushing made in one piece with a double gear, said bushing being displaceable on a shaft of the gear drive, along with a disk that is in driving connection with the shifting device.

* * * * *